United States Patent [19]

McDermott

[11] 4,082,480

[45] Apr. 4, 1978

[54] FLUID PRESSURE DEVICE AND IMPROVED GEROLER® FOR USE THEREIN

[75] Inventor: Hugh L. McDermott, Edina, Minn.

[73] Assignee: Eaton Corporation, Cleveland, Ohio

[21] Appl. No.: 716,911

[22] Filed: Aug. 23, 1976

[51] Int. Cl.[2] ..... F04B 49/00; F04C 1/02

[52] U.S. Cl. ..... 417/283; 417/310; 418/61 B; 418/157

[58] Field of Search ..... 418/171, 61 R, 61 B, 418/180, 181, 157; 417/310, 283

[56] References Cited

U.S. PATENT DOCUMENTS

| | | | |
|---|---|---|---|
| 2,912,937 | 11/1959 | Insley | 418/61 R |
| 3,139,835 | 7/1964 | Wilkinson | 418/180 X |
| 3,778,197 | 12/1973 | Takagi | 418/61 B |
| 3,964,842 | 6/1976 | White, Jr. | 418/61 B X |

FOREIGN PATENT DOCUMENTS

| | | | |
|---|---|---|---|
| 1,394,128 | 5/1975 | United Kingdom | 418/61 B |

*Primary Examiner*—Carlton R. Croyle
*Assistant Examiner*—Leonard Smith
*Attorney, Agent, or Firm*—L. Kasper

[57] ABSTRACT

A rotary fluid pressure device such as a motor or pump of the type utilizing a Geroler® gear set. The internal teeth of the Geroler® are tubular members mounted on bearings to be slightly movable. Between each adjacent pair of tubular teeth is a check valve in the form of a roller which is mounted to be movable slightly more than are the tubular teeth. A resilient band surrounds the rollers, biasing each of them inwardly toward engagement with the adjacent teeth, but permitting each of the roller check valves to move out of sealing engagement with the adjacent teeth when the fluid pressure in the adjacent volume chamber exceeds the combined biasing force of the resilient band and the fluid in the outer fluid chamber. The invention provides a low cost Geroler® gear set permitting greater manufacturing tolerances, and having improved low speed characteristics and volumetric efficiency, resulting from minimized tooth-tip leakage.

21 Claims, 5 Drawing Figures

FLUID PRESSURE DEVICE AND IMPROVED GEROLER ® FOR USE THEREIN

BACKGROUND OF THE DISCLOSURE

The present invention relates to rotary fluid pressure devices, and more particularly, to an improved Geroler ® gear set for use therein.

It will become apparent from the subsequent description that the invention is equally adapted for use in any gear set comprising an internally toothed member and an externally toothed member disposed eccentrically within the internally toothed member, in which each of the toothed members rotate about a fixed axis. However, the present invention is especially advantageous when applied to a Geroler ® gear set wherein the axis of the externally toothed member is not fixed, but rather, orbits about the axis of the internally toothed member. Therefore, the present invention will be described in connection with a rotary fluid pressure device utilizing a Geroler ® gear set. It should also be apparent that the present invention may be advantageously applied to a Geroler ® gear set in which the externally toothed member is held stationary, and the internally toothed member orbits and rotates relative thereto.

Geroler ® gear sets (i.e., those in which the teeth of the internally toothed member comprise rollers) were developed in response to various problems associated with Gerotor ® gear sets (i.e., those in which the teeth of the internally toothed member are formed integrally therewith). Among the problems associated with Gerotor ® gear sets was the extreme manufacturing precision required in the machining of the internally toothed member as well as the related problem of tooth-tip leakage and the resulting poor volumetric efficiency.

Although the development of Geroler ® gear sets overcame or minimized many of the problems associated with Gerotor ® gear sets, other problems still remained, and several new ones resulted. Among these is the extreme precision required in the machining of the rollers and pockets, especially as the axial length of the gear set increases. A problem which is associated with both Gerotor ® and Geroler ® gear sets is the extreme accuracy required in the valve timing. For example, in a motor, when the largest expanding volume chamber first begins to contract, if the valving to the exhaust line opens late there is a momentary pressure buildup within the contracting volume chamber such that the parts of the gear set are subjected to a stress, and upon opening of the valving, the builtup pressure may cause a shock wave in the exhaust line of several thousand psi or more, resulting in noisy operation and possible damage within the motor.

SUMMARY OF THE INVENTION

Accordingly, it is an object of the present invention to provide an improved fluid pressure device and a Geroler ® gear set for use therein which utilizes many of the functional advantages of prior art Geroler ® gear sets but which overcome and minimize some of the problems thereof.

It is a more specific object of the present invention to provide a Geroler ® gear set which eliminates the need for a precisely machined pocket to provide support for each of the rollers comprising the internal teeth.

It is a further object of the present invention to provide a Geroler ® gear set having a check valve between each adjacent pair of internal teeth to limit the pressure buildup in the adjacent volume chamber, the check valve also serving to define the volume chamber.

The above and other objects of the present invention are accomplished by the provision of a rotary fluid pressure device of the type including a housing defining a fluid inlet port and a fluid outlet port, an internally toothed assembly disposed within the housing, and an externally toothed member eccentrically disposed within the internally toothed assembly for relative movement therebetween. The internally toothed assembly includes a plurality of internal teeth, mounted to be movable in as least a radial direction. The internal teeth and the external teeth interengage to define a plurality of expanding and contracting volume chambers during the relative movement. A check valve is disposed between at least one pair of adjacent internal teeth and normally in engagement with each of the pair of internal teeth. The assembly includes means exerting a force biasing the check valve toward engagement with the pair of internal teeth and the housing and the pair of internal teeth adjacent the check valve cooperate to define a fluid chamber disposed radially therebetween, the fluid chamber being in fluid communication with either the inlet port or the outlet port. The check valve is operable to permit fluid to pass therethrough into the fluid chamber when fluid pressure in the volume chamber adjacent the check valve is sufficient to overcome the biasing force acting on the check valve.

In accordance with another aspect of the present invention, each of the internal teeth comprises a tubular member mounted on bearings, and between each pair of adjacent internal teeth is a check valve comprising a roller member mounted to be movable a distance slightly greater than are the internal teeth.

DESCRIPTION OF THE PREFERRED EMBODIMENTS

Figure 1:
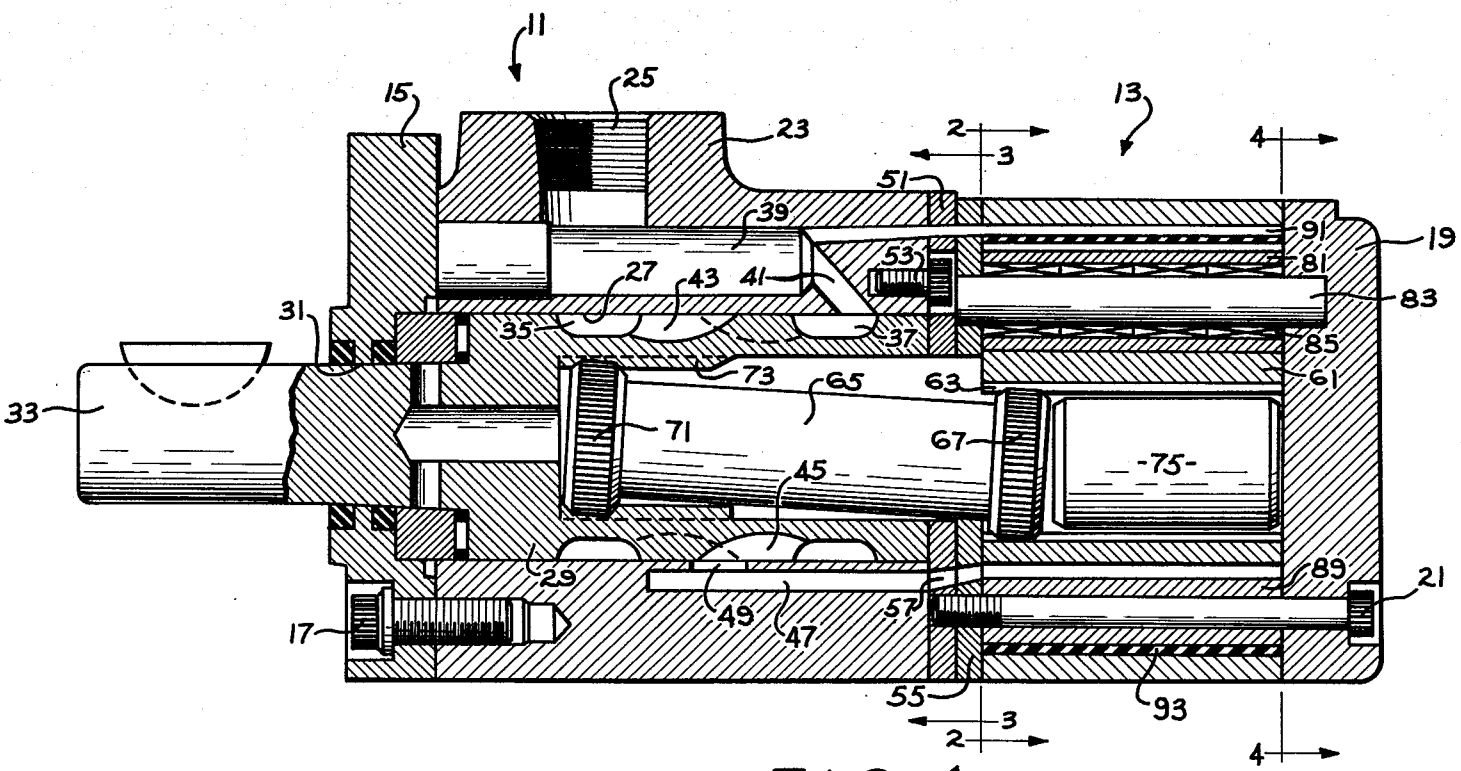
FIG. 1 is an axial cross-section of a rotary fluid pressure device utilizing the present invention.

Referring now to the drawings, which are not intended to limit the invention, FIG. 1 is an axial cross-section of a fluid motor of the type to which the present invention may be applied and which is illustrated in greater detail in U.S. Pat. No. 3,606,598, assigned to the assignee of the present invention. It will be noted that the above-referenced patent is illustrated using a Gerotor ® gear set, but it will be clearly understood by those skilled in the art that the general description and functioning of the fluid motor will not be changed by the use therein of a Geroler ® gear set, and more specifically, by the gear set of the present invention.

The fluid motor of FIG. 1 is generally cylindrical and comprises several distinct sections. A valve housing section is indicated generally at 11, while a gear section or displacement mechanism is indicated generally at 13. Adjacent the valve housing section 11 is a front cover plate 15, attached to the valve housing section 11 by a plurality of axially extending bolts 17. Similarly, adjacent the gear section 13 is an end cover plate 19, attached through the gear section 13, by a plurality of axially extending bolts 21. The bolts 21 serve an additional function which will be described in detail subsequently.

The valve housing section 11 includes a housing 23 which defines an inlet port 25, and an outlet port (not shown). The housing 23 defines a cylindrical valve bore 27 within which is rotatably disposed a generally cylindrical valve 29. Projecting through and rotatably seated in a bore 31 of the front cover plate 15 is an output shaft 33, the valve 29 and output shaft 33 being formed integrally in the subject embodiment, although it should be noted that the valve and shaft could be separate and connected, as by means of a connecting pin.

The valve 29 is a cummutating valve of the type well known in the art and taught in greater detail in the above-referenced patent. The valve 29 includes a pair of annular, axially-spaced grooves 35 and 37. Groove 37 is shown in FIG. 1 in fluid communication with the fluid port 25 through an axial passage 39 and an angled passage 41. The valve 29 includes a plurality of axially-extending slots 43 which are circumferentially spaced and in fluid communication with the annular groove 35. The valve 29 also includes a plurality of axially-extending slots 45 which are circumferentially spaced and in fluid communication with the annular groove 37. The slots 43 and the slots 45 are positioned alternately around the circumference of the valve 29. The housing 23 further includes a plurality of axially extending passages 47, one of which is shown in FIG. 1 in fluid communication with a slot 45, through a radial bore 49. Thus, when the fluid pressure device shown in FIG. 1 is utilized as a fluid motor, with high pressure fluid entering fluid port 25, the commutating action of the valve 29 provides high pressure fluid to the expanding volume chambers of the gear section 13, while porting low pressure fluid from the contracting volume chambers to the outlet port, in a manner well known in the art and illustrated in the above-referenced patent. When the device is being utilized as a fluid pump, the rotary input to the shaft 33 and resulting commutating action of the valve 29 ports low pressure fluid entering port 25 to the expanding volume chambers of the gear section 13, while porting high pressure fluid from the contracting volume chambers to the outlet port.

Figure 2:
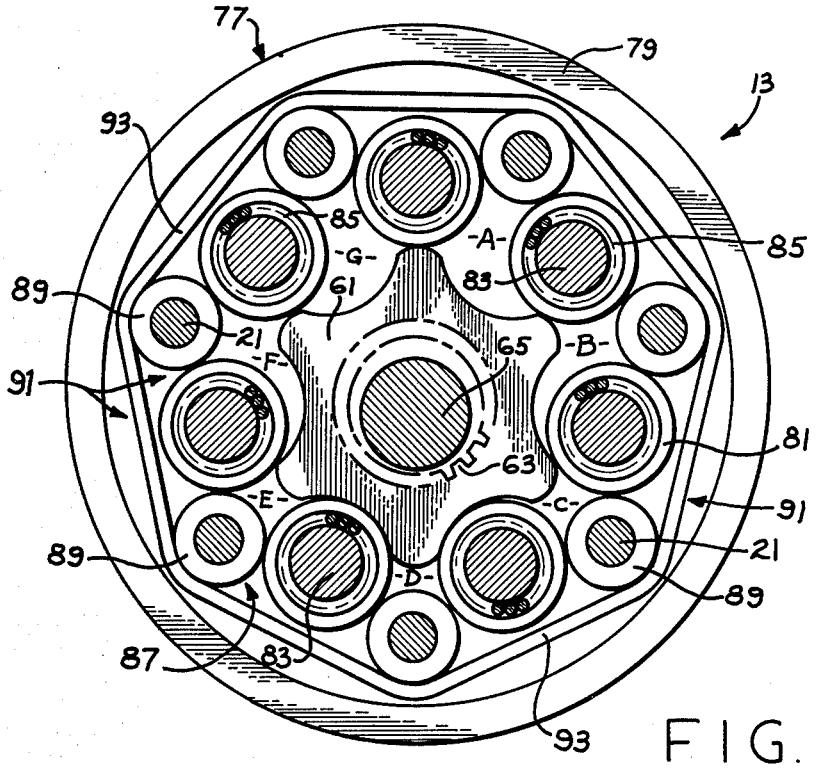
FIG. 2 is a transverse cross-section, taken on line 2—2 of FIG. 1, and on a larger scale.
Figure 3:
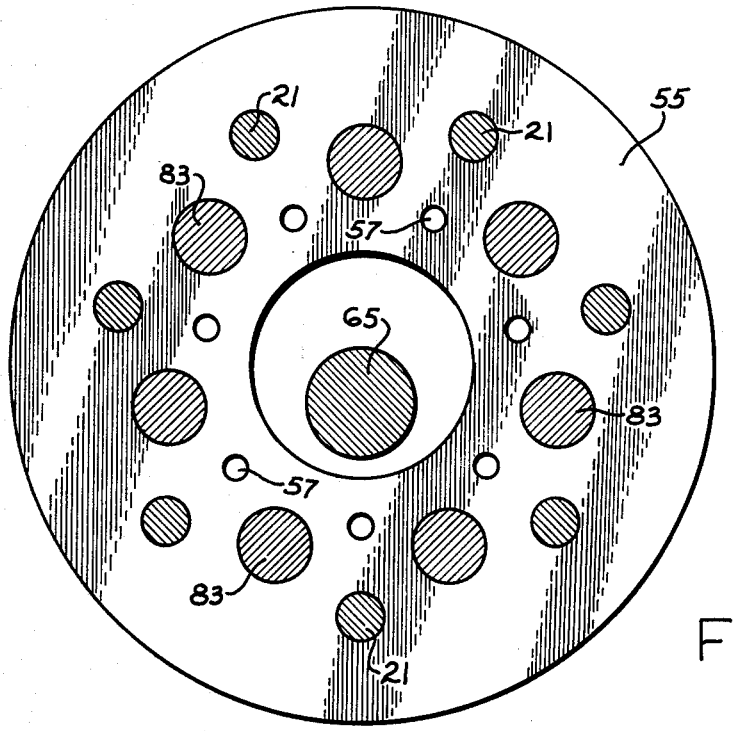
FIG. 3 is a transverse cross-section taken on line 3—3 of FIG. 1, and on the same scale as FIG. 2.
Figure 4:
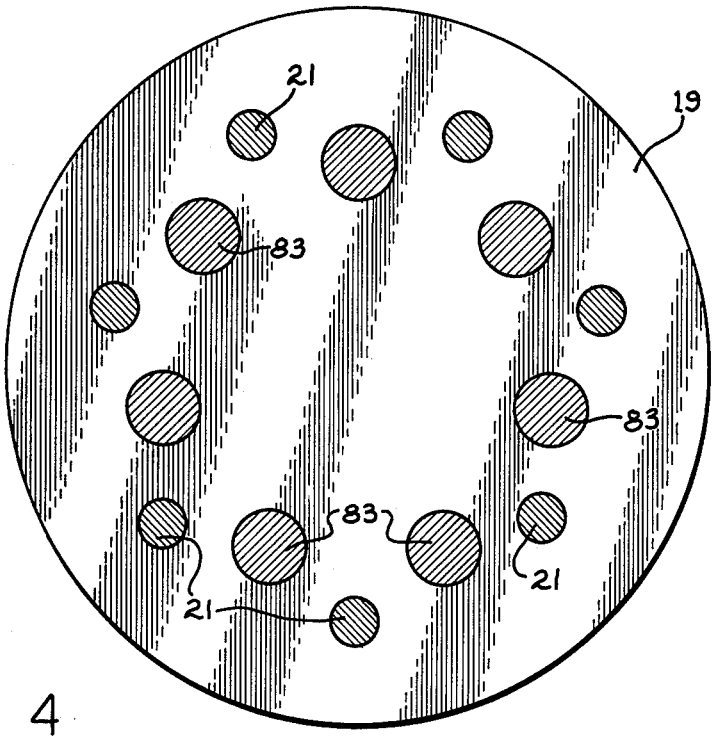
FIG. 4 is a transverse cross-section, taken on line 4—4 of FIG. 1, and on the same scale as FIG. 2.

Referring now to FIGS. 2, 3, and 4, in conjunction with FIG. 1, it may be seen that adjacent the valve housing 23 is disposed an adaptor plate 51, attached to the housing 23 by a plurality of bolts 53. Disposed between the valve plate 51 and the gear section 13 is a wear plate 55, the adaptor plate 51 and wear plate 55 cooperating to define a plurality of ports 57 communicating between the axial passages 47 and the volume chambers of the gear set 13. It should be clearly understood that the adaptor plate 51 and wear plate 55 form no essential part of the present invention, but that they are included merely to accommodate the various construction features of the novel Geroler® gear section disclosed hereinafter.

The gear section 13 includes an externally-toothed member (rotor) 61, defining a set of internal splines 63. A main drive shaft 65 includes a set of external splines 67 in splined engagement with the internal splines 63, and at the opposite end of the shaft 65 is a set of external splines 71 in engagement with a set of internal splines 73, formed on the I.D. of the valve 29. Disposed within the set of internal splines 63 is a cylindrical spacer member 75, having one end in engagement with the end cover plate 19, and its opposite end in engagement with the drive shaft 65 to insure the axial position thereof as is well known in the art.

Referring now primarily to FIG. 2, the gear section 13 includes, rather than the conventional ring-roller assembly as is known in the Geroler® gear art, an internally-toothed assembly 77. The assembly 77 includes an annular spacer ring 79 which is held in tight engagement, at its ends, with the wear plate 55 and end cover plate 19 by the threaded engagement of the bolts 21 into the adaptor plate 51.

Each of the internal teeth of the assembly 77 comprises a tubular member 81 which is mounted on a bearing post 83 in a manner which permits the tubular member 81 to rotate and move radially a slight amount relative to the bearing post 83. Disposed between the bearing post 83 and the tubular member 81 to permit such movement thereof is suitable bearing means 85, such as a set of needle bearings. Generally, the permissible movement of the tubular member 81 should be less than about 0.004 inches ($1.01 \times 10^{-2}$cm), and in the preferred embodiment, the radial movement is maintained in the range of about 0.001 inches ($2.54 \times 10^{-3}$cm) to about 0.003 inches ($7.62 \times 10^{-3}$cm). By referring again to FIG. 1, it will be noted that each of the bearing posts 83 is rigidly supported, at one end, by the wear plate 55 and at the other end, by the end cover plate 19.

Disposed between each adjacent pair of tubular members 81, and normally in engagement therewith, is a check valve, generally designated 87. Each check valve 87 comprises a generally cylindrical roller member 89, mounted on one of the bolts 21 in a manner permitting the roller 89 to freely rotate and move radially relative to the bolt 21. The permissible radial movement of the roller 89, for any given gear set, should be at least equal to the permissible radial movement of each of the adjacent tubular members 81. Therefore, in the subject embodiment, each of the roller members 89 is mounted to permit a radial movement of at least about 0.003 inches ($7.62 \times 10^{-3}$cm), and preferably, no more than about 0.006 inches ($1.52 \times 10^{-2}$cm). It should be appreciated that the relative sizes of the tubular members 81 and the roller members 89, as well as the relative locations of their axes, are not an essential feature of the present invention, but are illustrated as in FIG. 2 as a preferred embodiment, and by way of example.

Under normal operation conditions, each of the roller members 89 should be in sealing, rolling engagement with the adjacent pair of tubular members 81. When such is the case, each of the rollers 89 and the adjacent tubular members 81 cooperate with the rotor 61 to define a volume chamber, the volume chambers within being designated, clockwise around the gear set 13, as A, B, C, D, E, F, and G.

The tubular members 81 and roller members 89 also cooperate with the spacer ring 79 to define therebetween a fluid chamber 91, which is preferably in fluid communication with whichever of the fluid ports (port 25 or the one not shown) is at low pressure, as will be described in greater detail subsequently.

Surrounding the set of roller members 89, and in biasing engagement therewith, is a resilient band member 93, the function of which is to exert a sufficient biasing force on each of the roller members 89 to maintain it in engagement with the adjacent tubular members 91, unless the fluid pressure in the adjacent volume chamber exceeds a certain predetermined pressure level. If such a pressure rise occurs, the pressure in the volume chamber overcomes the biasing force of the band member 93, thus relieving the pressure in the volume chamber to the fluid chamber 91, from where it is ported to the low pressure port. For example, when the device is functioning as a motor and assuming that volume chambers A, B, and C are expanding and subjected to high pressure fluid, it will be apparent to those skilled in the art that volume chamber G is just beginning to contract, as shown in FIG. 2. As described previously, if there is any error in the valve timing and volume chamber G begins to contract before it is in fluid communication with exhaust, any excessive pressure rise in volume chamber G will unseat the adjacent check valve roller member 89, relieving the fluid to the fluid chamber 91 which is always in fluid communication with exhaust (the low pressure side). It should be apparent that as soon as the pressure in volume chamber G is relieved, the band member 93 will quickly return the roller member 89 to sealing engagement with the adjacent tubular teeth 81 and the gear section 13 will then continue to function as normal. From the foregoing description of the function of the band member 93, it should be apparent that although it has been illustrated in FIG. 1 as comprising rubber or a similar material, band member 93 may, within the scope of the invention, comprise any material which will permit the check valve roller members 89 to unseat when subjected to sufficient pressure, and then be returned quickly to sealing engagement when the pressure is relieved. For example, the band member 93 may comprise a length of clock spring, or any of a number of other well known spring-like metallic elements which display the desired resiliency. Also, although the band member 93 is illustrated as one continuous member, it should be understood that as used herein the term "continuous" could include a member which is not truly continuous, but which passes around or encompasses all of the check valve roller members 89 to which reference is being made.

It has been observed that the Geroler® gear set of the present invention has an improved mechanical efficiency. It is believed that this is accounted for primarily by the use of the band member 93 in conjunction with the movability of the tubular teeth 81 and roller members 89. As the pattern of high pressure and low pressure in the volume chambers rotates and the rotor 61 orbits and rotates, the tubular teeth 81 are constrained to "follow" the rotor 61. In conventional Geroler® gear sets, the teeth are fixed within closely-fitting rigid pockets, such that, when the rotor exerts a large force on the roller, there is a frictional force between the roller and the pocket, this friction subtracting from the number of horsepower of work output for a given input power. At the same time, certain of the rollers may be subjected to very little force by the rotor, or may even be out of sealing engagement with the rotor, in which case, tooth-tip leakage is likely to occur. One result of these variations in engagement force between the rollers and the rotor is a very uneven distribution of the torque loadings on the rollers.

In the present invention, the tubular teeth 81 are always biased toward sealing engagement with the rotor 61 by the band member 93, to establish at least a minimum force of engagement between the teeth and the rotor. At the same time, the outward movement of each of the tubular teeth 81 is limited by only the respective bearing mounting and the biasing force of the band member 93, such that frictional forces acting on the tubular teeth 81 dissipate a much smaller portion of the input power, and the torque loading on the tubular teeth 81 tend to be distributed much more evenly.

By way of demonstrating the improved performance which is possible when utilizing a Geroler® gear set made in accordance with the teachings of the present invention, tests were performed to determine the mechanical efficiency of a fluid motor using the invention. For test purposes, mechanical efficiency relates to the torque output (inch-pounds) of the motor v. input fluid pressure (psi), with the measured torque output being expressed as a percentage of the theoretical torque output for a given input pressure. The test included three fluid motors which were substantially identical, with the exception of the gear section. The first unit utilized a conventional Gerotor® gear set and had a mechanical efficiency of 74%, the second unit utilized a conventional Geroler® gear set and had an efficiency of 81%, and the third included the Geroler® gear set of the present invention and had a mechanical efficiency of 94%.

The ability of the Geroler® gear set of the present invention to operate with lower frictional losses permits it to run at lower speeds and still maintain good volumetric efficiency. A closely related feature is that a fluid motor utilizing the invention may be rated for a higher starting torque, especially if the bearings 85 are properly selected and are capable of operation at low speeds without loss of lubrication. The ability to operate at low speeds, and with a more even torque loading, makes the Geroler® gear set of the present invention useful in servo-control devices, particularly, as the meter in a steering control valve for use in full fluid-linked hydrostatic steering systems.

Figure 5:
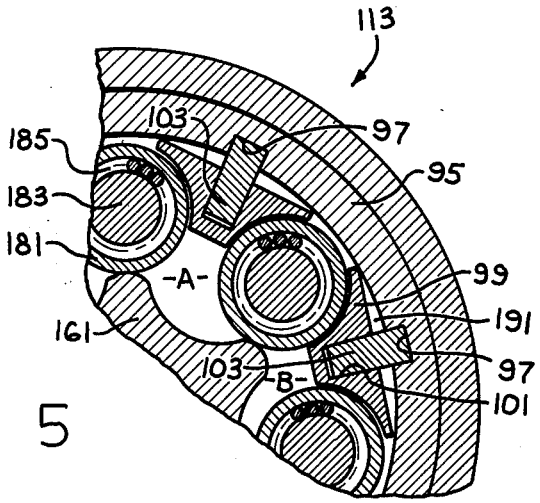
FIG. 5 is a fragmentary cross-section, similar to FIG. 2, illustrating an alternative embodiment of the present invention.

Referring now to FIG. 5, there is illustrated one alternative embodiment of the present invention with like elements being referred to by like numerals, plus 100. It should be noted that unlike FIG. 2, FIG. 5 is taken on a plane intermediate the ends of the gear set 113. In the embodiment of FIG. 5, gear section 113 includes a spacer ring 95 which has a relatively greater wall thickness than the spacer ring 79 of the preferred embodiment. The spacer ring 95 defines a plurality of axially-extending grooves 97. Disposed adjacent each of the grooves 97, and between a pair of adjacent tubular teeth 181, is a specially configured check valve member 99 which, in a manner similar to the roller member 89 of the preferred embodiment, has substantially the identical axial length as the tubular teeth 181. The check valve member 99 defines an axially-extending slot 101 and a key member 103 is disposed to be seated within both the slot 101 and the groove 97. Each of the check valve members 99 includes a pair of generally arcuate surfaces, conforming approximately to the surface of the adjacent tubular teeth 181, thereby providing increased sealing area between the check valve 99 and the tubular tooth 181. It should be noted that the alternative embodiment of FIG. 5 may be preferred in situations where the axial length of the gear section is such that the cylindrical roller member 89 has a tendency to bow slightly under pressure, thus losing its sealing engagement with the adjacent tubular tooth 81, especially near the center of the gear section 13. In the embodiment of FIG. 5, however, the check valve member 99 receives substantially the same amount of back-up support from the key member 103 over its entire axial length, eliminating any tendency for the check valve member 99 to bow under pressure. Depending upon the relative fluid pressures in the volume chambers and the fluid chamber 191, as well as the intended radial movement of the check valve member 99, it may be desirable to utilize some form of biasing means in association with each of the key members 103. For example, an appropriate type of spring may be disposed in the groove 97 or the slot 101 to bias the check valve member 99 radially inward.

It is believed that modifications and alternations of these embodiments will occur to others upon a reading and understanding of the specification and it is my intention to include all such modifications and alterations as part of the invention insofar as they come within the scope of the appended claims.

I claim:

1. A rotary fluid pressure device, comprising:

(a) housing means defining a fluid inlet port and a fluid outlet port;

(b) an internally-toothed assembly fixedly disposed within said housing means;

(c) an externally-toothed member eccentrically disposed within said internally-toothed assembly for relative orbital and rotational movement therebetween;

(d) said internally-toothed assembly including a plurality of internal teeth, said internal teeth and said external teeth interengaging to define a plurality of expanding and contracting volume chambers during said relative movement;

(d) said housing means and said internal teeth cooperating to define a fluid chamber disposed radially therebetween, extending circumferentially about said fluid pressure device, said fluid chamber being in fluid communication with one of said fluid inlet port and said fluid outlet port; and (f) check valve means operatively disposed between each adjacent pair of internal teeth, each check valve means including a movable check valve member normally biased radially inwardly into contact with each of said pair of adjacent internal teeth and being operable to permit fluid to pass therethrough, into said fluid chamber, when fluid pressure in the adjacent volume chamber is greater than the fluid pressure in said fluid chamber.

2. A rotary fluid pressure device as claimed in claim 1 including means biasing said check valve means radially inward generally toward the center of said internally-toothed assembly and toward sealing engagement with said adjacent pair of internal teeth.

3. A rotary fluid pressure device as claimed in claim 1 wherein each of said internal teeth comprises a generally cylindrical member mounted to permit at least radial movement thereof.

4. A rotary fluid pressure device as claimed in claim 3 wherein each of said cylindrical members is generally tubular and is rotatably mounted on bearing means to permit radial movement of said tubular member in the range of about 0.001 inches ($2.54 \times 10^{-3}$cm) to about 0.003 inches ($7.62 \times 10^{-3}$cm).

5. A rotary fluid pressure device as claimed in claim 4 wherein each of said check valve means comprises a tubular roller rotatably mounted to permit radial movement of said tubular roller in the range of about 0.003 inches ($7.62 \times 10^{-3}$cm) to about 0.006 inches ($1.52 \times 10^{-2}$cm).

6. A rotary fluid pressure device as claimed in claim 1 wherein each of said check valve means comprises a roller member biased by fluid pressure in said fluid chamber toward sealing engagement with each of said adjacent internal teeth.

7. A rotary fluid pressure device as claimed in claim 6 wherein each of said roller members is mounted to permit radial movement at least as great as that of said generally cylindrical members.

8. A rotary fluid pressure device, comprising:

(a) housing means defining a fluid inlet port and a fluid outlet port;

(b) an internally-toothed assembly disposed within said housing means;

(c) an externally-toothed member eccentrically disposed within said internally-toothed assembly for relative movement therebetween;

(d) said internally-toothed assembly including a plurality of internal teeth mounted to be movable in at least a radial direction, said internal teeth and said external teeth interengaging to define a plurality of expanding and contracting volume chambers during said relative movement;

(e) check valve means disposed between at least one pair of adjacent internal teeth and normally in engagement with each of said pair of internal teeth;

(f) means exerting a force biasing said check valve means toward engagement with said pair of internal teeth;

(g) said housing means and said one pair of adjacent internal teeth cooperating to define a fluid chamber disposed radially therebetween, said fluid chamber being in fluid communication with one of said fluid inlet port and said fluid outlet port; and (h) said check valve means being operable to permit fluid to pass therethrough into said fluid chamber when fluid pressure in the volume chamber adjacent said check valve means is sufficient to overcome the biasing force on said check valve means.

9. A rotary fluid pressure device as claimed in claim 8 wherein said adjacent internal teeth are biased generally radially inward by said check valve means and the fluid pressure in said fluid chamber acting on said check valve means.

10. A rotary fluid pressure device as claimed in claim 8 including check valve means disposed between each pair of adjacent internal teeth and normally in engagement therewith.

11. A rotary fluid pressure device as claimed in claim 10 including means exerting a force biasing each of said check valve means toward engagement with the respective pair of adjacent internal teeth.

12. A rotary fluid pressure device as claimed in claim 11 wherein said biasing means comprises a resilient, generally continuous member surrounding said check valve means and in biasing engagement with the outer periphery of each of said check valve means.

13. A rotary fluid pressure device as claimed in claim 10 wherein each of said internal teeth comprises a generally cylindrical member.

14. A rotary fluid pressure device as claimed in claim 13 wherein each of said check valve means comprises a roller member, each of said roller members being mounted to be movable in at least a radial direction and for a distance at least as great as that of the respective adjacent internal teeth.

15. A rotary fluid pressure device as claimed in claim 14 wherein each of said cylindrical members and each of said roller members is rotatably mounted.

16. A rotary fluid pressure device as claimed in claim 13 wherein each of said generally cylindrical members is bearing mounted to permit radial movement of said members less than about 0.004 inches ($1.016 \times 10^{-2}$cm).

17. A rotary fluid pressure device as claimed in claim 16 wherein each of said check valve means comprises a roller member mounted to permit radial movement greater than about 0.003 inches ($7.62 \times 10^{-3}$cm).

18. A rotary fluid pressure device, comprising:

(a) housing means defining a fluid inlet port and a fluid outlet port;

(b) an internally toothed assembly fixedly disposed within said housing means, defining a center, and including a plurality N of cylindrical internal teeth, each of said internal teeth being mounted to be rotatable about its axis of rotation;

(c) an externally-toothed member eccentrically disposed within said internally-toothed assembly for orbital and rotational movement therein and having a plurality N-1 of external teeth, said internal teeth and said external teeth interengaging to define a plurality N of expanding and contracting volume chambers during said movement of said externally-toothed member;

(d) a roller member disposed between each pair of adjacent internal teeth, each of said roller members being rotatable about its axis of rotation and being in rolling engagement with each of said pair of adjacent cylindrical internal teeth, said axes of rotation of said roller members being disposed radially outward from said center a greater distance than said axes rotation of said internal teeth; and (e) said housing means and said internal teeth cooperating to define a fluid chamber disposed radially therebetween, said fluid chamber being in fluid communication with one of said fluid inlet port and said fluid outlet port.

19. A rotary fluid pressure device as claimed in claim 18 wherein each of said roller members is mounted to be radially movable, relative to its axis of rotation by at least about 0.003 inches ($7.62 \times 10^{-3}$cm).

20. A rotary fluid pressure device as claimed in claim 19 including means biasing said roller members radially inward toward said center of said internally-toothed assembly.

21. A rotary fluid pressure device as claimed in claim 20 wherein said biasing means comprises a resilient, generally continuous band member in surrounding engagement with said roller members.

* * * * *

UNITED STATES PATENT AND TRADEMARK OFFICE

CERTIFICATE OF CORRECTION

PATENT NO. : 4,082,480

DATED : 4/4/78

INVENTOR(S) : Hugh L. McDermott

It is certified that error appears in the above-identified patent and that said Letters Patent are hereby corrected as shown below:

Col. 5, line 1: "91" should read 81.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*